US011988227B2

(12) United States Patent
Iwakiri et al.

(10) Patent No.: US 11,988,227 B2
(45) Date of Patent: May 21, 2024

(54) COMPRESSOR HOUSING AND CENTRIFUGAL COMPRESSOR

(71) Applicant: MITSUBISHI HEAVY INDUSTRIES ENGINE & TURBOCHARGER, LTD., Sagamihara (JP)

(72) Inventors: Kenichiro Iwakiri, Tokyo (JP); Tadashi Kanzaka, Tokyo (JP); Yutaka Fujita, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 0 days.

(21) Appl. No.: 18/018,213

(22) PCT Filed: Sep. 7, 2020

(86) PCT No.: PCT/JP2020/033826
§ 371 (c)(1),
(2) Date: Jan. 26, 2023

(87) PCT Pub. No.: WO2022/049779
PCT Pub. Date: Mar. 10, 2022

(65) Prior Publication Data

US 2023/0304507 A1 Sep. 28, 2023

(51) Int. Cl.
*F04D 29/42* (2006.01)
*F04D 29/68* (2006.01)

(52) U.S. Cl.
CPC ..... *F04D 29/4213* (2013.01); *F04D 29/685* (2013.01)

(58) Field of Classification Search
CPC ... F04D 29/4213; F04D 29/542; F04D 29/685
See application file for complete search history.

(56) References Cited

U.S. PATENT DOCUMENTS 5,277,541 A * 1/1994 Palmer ..... F04D 29/4213 415/206
2006/0088412 A1* 4/2006 Barton ..... F01D 5/26 415/206
2018/0163731 A1 6/2018 Matsuda et al.

FOREIGN PATENT DOCUMENTS

JP 2008-175124 A 7/2008
JP 5720267 B2 5/2015
(Continued)

OTHER PUBLICATIONS

International Preliminary Report on Patentability and Written Opinion of the International Searching Authority for International Application No. PCT/JP2020/033826, dated Mar. 16, 2023, with an English translation.
(Continued)

*Primary Examiner* — Brian O Peters
(74) *Attorney, Agent, or Firm* — Birch, Stewart, Kolasch & Birch, LLP

(57) ABSTRACT

A compressor housing includes: when an intake side in an axial direction of the centrifugal compressor is defined as a front side, and a side opposite to the intake side in the axial direction is defined as a rear side, a shroud surface including a surface facing a tip of an impeller blade of the impeller with a predetermined gap; a front-side inner peripheral surface formed on the front side of the shroud surface in the axial direction and positioned on an outer side in a radial direction than a front end of the shroud surface; and plurality of grooves formed in the front-side inner peripheral surface at intervals in a circumferential direction wherein each of the plurality of grooves includes: an inclined portion whose depth gradually increases toward a rotation direction of the impeller; and a stepped portion formed at a downstream end of the inclined portion in the rotation direction.

11 Claims, 8 Drawing Sheets

(56) References Cited

FOREIGN PATENT DOCUMENTS

| | | | |
|---|---|---|---|
| JP | 2017-210902 | A | 11/2017 |
| JP | 6263997 | B2 | 1/2018 |
| JP | 6279524 | B2 | 2/2018 |
| JP | 2018-96302 | A | 6/2018 |
| JP | 2019-19765 | A | 2/2019 |
| JP | 2019-218941 | A | 12/2019 |

OTHER PUBLICATIONS

International Search Report and Written Opinion of the International Searching Authority for International Application No. PCT/JP2020/033826, dated Nov. 10, 2020.

* cited by examiner

COMPRESSOR HOUSING AND CENTRIFUGAL COMPRESSOR

TECHNICAL FIELD

The present disclosure relates to a compressor housing for rotatably housing an impeller of a centrifugal compressor, and a centrifugal compressor including the compressor housing.

BACKGROUND

Centrifugal compressors used in compressors of vehicle or marine turbochargers apply kinetic energy to a fluid (for example, air) by rotating an impeller to discharge the fluid toward the outer side in the radial direction and obtains a pressure rise of the fluid utilizing centrifugal force. Such centrifugal compressors are required to have a high pressure ratio and high efficiency over a wide operating range, and various improvements have been made.

For example, at low flow rates where the intake air flow rate of a centrifugal compressor is low, an unstable phenomenon called surging may occur in which the fluid vibrates violently in the flow direction of the fluid. When surging occurs, a reverse flow occurs in the vicinity of a shroud surface in a direction opposite to the flow of air introduced from an intake port, and this reverse flow may reduce the efficiency of the centrifugal compressor.

CITATION LIST

Patent Literature

Patent Document 1: JP2017-210902A

SUMMARY

Technical Problem

In Patent Literature 1, a recess formed in the wall surface of an inflow passage that guides air to the impeller guides the reverse flow described above toward the inner side in the radial direction and pressurizes the air flowing toward the impeller, thereby suppressing the reverse flow.

In order to improve the efficiency of a centrifugal compressor, it is necessary to suppress the pressure loss of the operating fluid flowing through the compressor housing as much as possible.

With the foregoing in view, an object of at least one embodiment of the present invention is to provide a compressor housing capable of improving efficiency of a centrifugal compressor, and a centrifugal compressor including the compressor housing.

Solution to Problem

A compressor housing according to the present disclosure is: a compressor housing for rotatably housing an impeller of a centrifugal compressor, including: when an intake side in an axial direction of the centrifugal compressor is defined as a front side, and a side opposite to the intake side in the axial direction is defined as a rear side, a shroud surface including a surface facing a tip of an impeller blade of the impeller with a predetermined gap; a front-side inner peripheral surface formed on the front side of the shroud surface in the axial direction and positioned on an outer side in a radial direction than a front end of the shroud surface; and a plurality of protrusions protruding toward an inner side in the radial direction from the front-side inner peripheral surface and formed between adjacent grooves among a plurality of grooves formed in the front-side inner peripheral surface at intervals in a circumferential direction, wherein each of the plurality of grooves includes: an inclined portion whose depth gradually increases toward a rotation direction of the impeller; and a stepped portion formed at a downstream end of the inclined portion in the rotation direction.

A centrifugal compressor according to the present disclosure includes the compressor housing.

Advantageous Effects

According to at least one embodiment of the present disclosure, a compressor housing that can improve efficiency of a centrifugal compressor and a centrifugal compressor including the compressor housing are provided.

DETAILED DESCRIPTION

Figure 1:
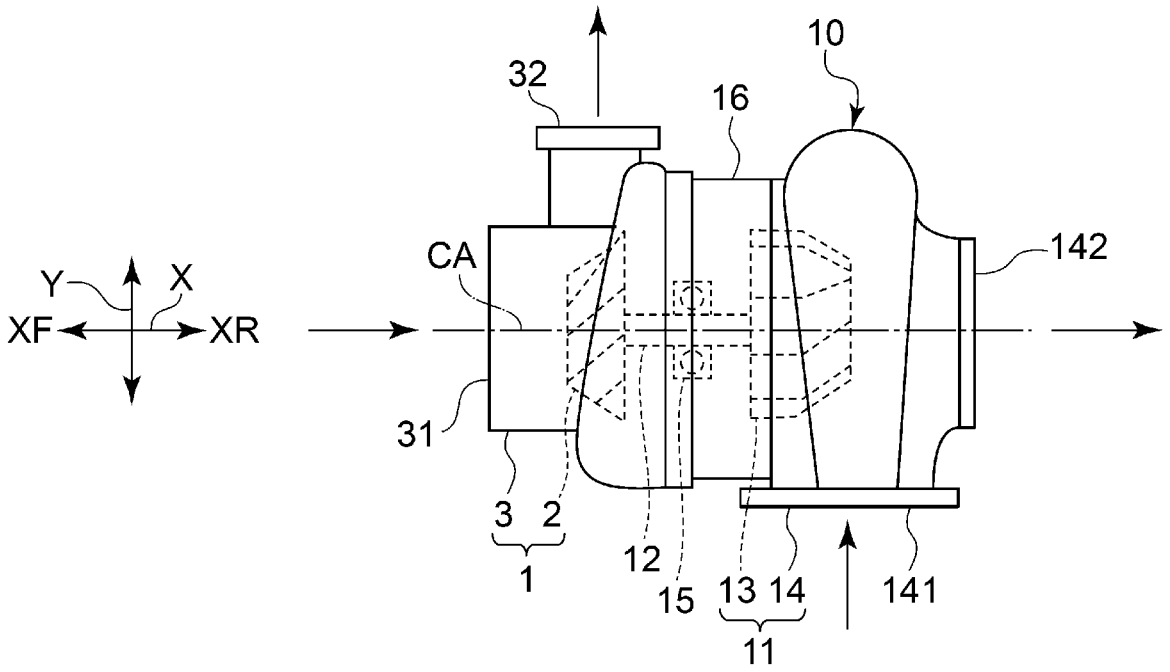
FIG. 1 is an explanatory diagram for explaining the configuration of a turbocharger provided with a centrifugal compressor according to an embodiment.

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

For example, an expression of relative or absolute arrangement such as "in a direction", "along a direction", "parallel", "orthogonal", "centered", "concentric" and "coaxial" shall not be construed as indicating only the arrangement in a strict literal sense, but also includes a state in which the arrangement is relatively displaced by a tolerance, or by an angle or a distance whereby it is possible to achieve the same function.

For example, an expression of an equal state such as "same", "equal" and "uniform" shall not be construed as indicating only the state in which the feature is strictly equal, but also includes a state in which there is a tolerance or a difference that can still achieve the same function.

Furthermore, in the present specification, an expression of a shape such as a rectangular shape or a cylindrical shape shall not be construed as only the geometrically strict shape, but also includes a shape with unevenness or chamfered corners within the range in which the same effect can be achieved.

Furthermore, in the present specification, an expression such as "comprise", "include", "have", "contain" and "constitute" are not intended to be exclusive of other components.

The same reference numerals are assigned to the same configurations, and the description thereof may be omitted.

(Centrifugal Compressor and Turbocharger)

Figure 2:
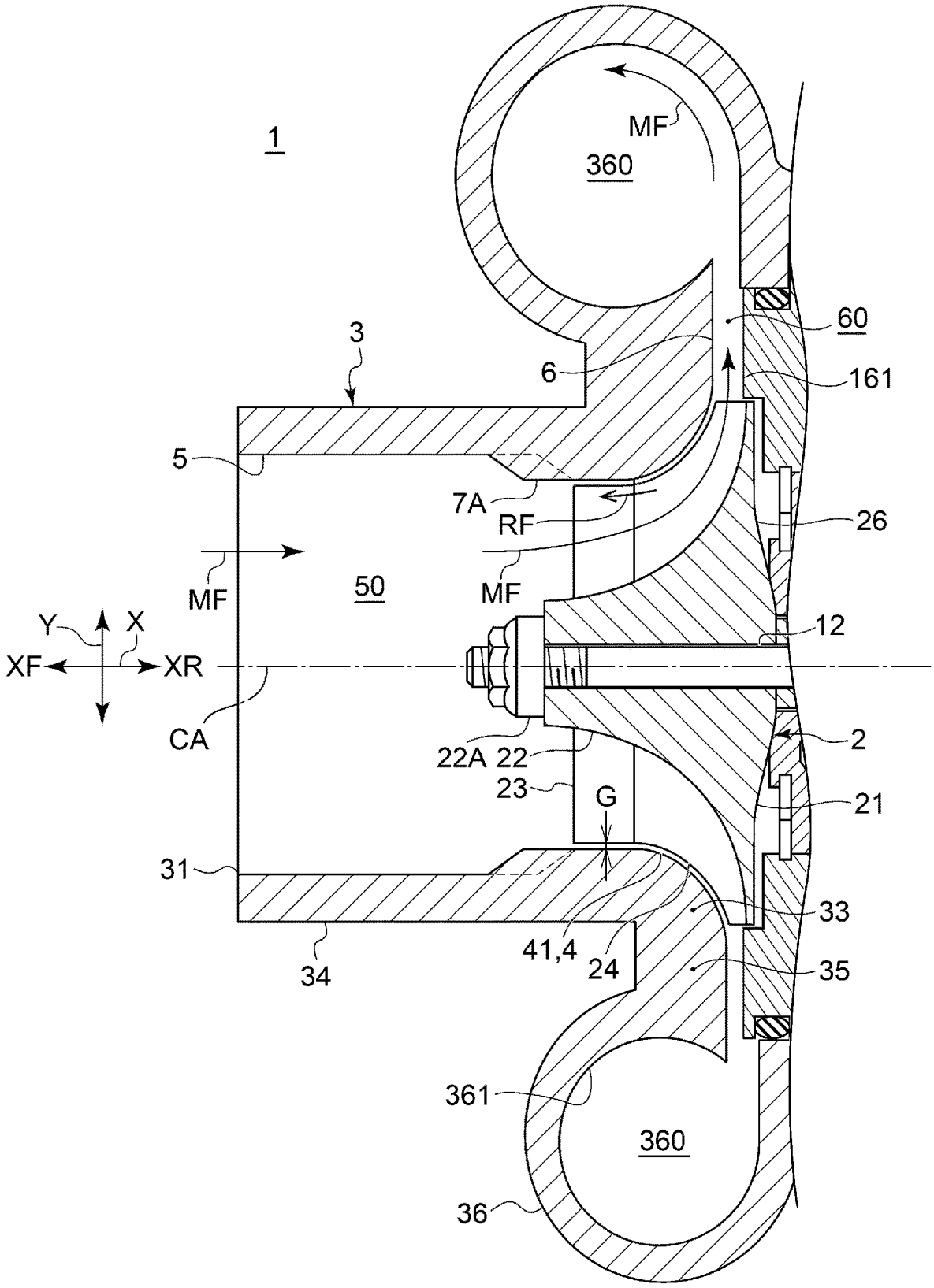
FIG. 2 is a schematic cross-sectional view schematically showing the compressor side of a turbocharger having a centrifugal compressor according to an embodiment, and is a schematic cross-sectional view including the axis of the centrifugal compressor.

FIG. 1 is an explanatory diagram for explaining the configuration of a turbocharger provided with a centrifugal compressor according to an embodiment. FIG. 2 is a schematic cross-sectional view schematically showing the compressor side of a turbocharger having a centrifugal compressor according to an embodiment, and is a schematic cross-sectional view including the axis of the centrifugal compressor.

As shown in FIGS. 1 and 2, a centrifugal compressor 1 according to some embodiments of the present disclosure includes an impeller 2 and a compressor housing 3 that rotatably houses the impeller 2.

The centrifugal compressor 1 can be applied to, for example, a turbocharger 10 for automobiles, ships, or power generation, other industrial centrifugal compressors, blowers, and the like. In the shown embodiment, the centrifugal compressor 1 is mounted on the turbocharger 10. As shown in FIG. 1, the turbocharger 10 includes the centrifugal compressor 1, a turbine 11, and a rotating shaft 12. The turbine 11 includes a turbine rotor 13 mechanically connected to the impeller 2 via the rotating shaft 12 and a turbine housing 14 that rotatably houses the turbine rotor 13.

In the shown embodiment, as shown in FIG. 1, the turbocharger 10 further includes a bearing 15 that rotatably supports the rotating shaft 12 and a bearing housing 16 that is configured to house the bearing 15. The bearing housing 16 is arranged between the compressor housing 3 and the turbine housing 14, and is mechanically connected to the compressor housing 3 and the turbine housing 14 by fastening members (for example, fastening bolts or the like).

Hereinafter, as shown in FIG. 1, for example, the direction in which the axis CA of the centrifugal compressor 1, that is, the axis of the impeller 2 extends is defined as an axial direction X, and the direction orthogonal to the axis CA is defined as a radial direction Y. In the axial direction X, the upstream side in the intake direction of the centrifugal compressor 1 (the direction in which the main flow is introduced into the impeller 2), that is, the side where an intake port 31 is positioned with respect to the impeller 2 (left side in the figure) is defined as a front side XF. Further, in the axial direction X, the side opposite to the front side XF, that is, the downstream side (right side in the figure) in the intake direction of the centrifugal compressor 1 is defined as a rear side XR.

In the embodiment shown in FIG. 1, the compressor housing 3 has an intake port 31 for introducing fluid (for example, air) from the outside of the compressor housing 3 into the inside and a discharge port 32 for discharging the fluid having passed through the impeller 2 to the outside of the compressor housing 3. The turbine housing 14 has a turbine-side intake port 141 for introducing an operating fluid (for example, exhaust gas) for rotating the turbine rotor 13 from the outside to the inside of the turbine housing 14 and a turbine-side discharge port 142 for discharging the operating fluid having passed through the turbine rotor 13 to the outside of the turbine housing 14.

As shown in FIG. 1, the rotating shaft 12 has a longitudinal direction along the axial direction X. The rotating shaft 12 is mechanically connected to the impeller 2 on one side (the front side XF) in the longitudinal direction and is mechanically connected to the turbine rotor 13 on the other side (the rear side XR) in the longitudinal direction.

The turbocharger 10 rotates the turbine rotor 13 with the operating fluid introduced into the turbine housing 14 through the turbine-side intake port 141. Examples of the operating fluid include exhaust gas generated from an exhaust gas generator (not shown) (for example, an internal combustion engine such as an engine). Since the impeller 2 is mechanically connected to the turbine rotor 13 via the rotating shaft 12, it rotates in conjunction with the rotation of the turbine rotor 13. By rotating the impeller 2, the turbocharger 10 compresses the fluid introduced into the inside of the compressor housing 3 through the intake port 31, and sends the compressed fluid to a destination (for example, an internal combustion engine such as an engine) through the discharge port 32.

(Impeller)

As shown in FIG. 2, the impeller 2 includes a hub 21 and a plurality of impeller blades 23 provided on the outer surface 22 of the hub 21. Since the hub 21 is mechanically fixed to one side of the rotating shaft 12, the hub 21 and the plurality of impeller blades 23 are provided so as to be rotatable integrally with the rotating shaft 12 about the axis CA of the impeller 2. The impeller 2 is housed in the compressor housing 3 and configured to guide the fluid introduced from the front side XF in the axial direction X to the outer side in the radial direction Y.

In the shown embodiment, the outer surface 22 of the hub 21 is formed in a concave curved shape in which the distance from the axis CA of the impeller 2 increases as it advances from the front side XF to the rear side XR. The plurality of impeller blades 23 are arranged at intervals in the circumferential direction around the axis CA. The shroud surface 4 includes a surface 41 formed in a convex curved shape in which the distance from the axis CA of the impeller 2 increases as it advances from the front side XF toward the rear side XR. The tips (tip-side ends) 24 of the impeller blades 23 are positioned on the opposite side of a connecting portion (hub-side end) connected to the outer surface 22 of the hub 21. A gap G (clearance) is formed between the tip 24 and the surface 41 curved in a convex shape so as to face the tip 24.

(Compressor Housing)

In the shown embodiment, as shown in FIG. 2, the compressor housing 3 includes a shroud portion 33 including the shroud surface 4 described above, an intake air introduction portion 34 forming an intake air introduction path 50 of the centrifugal compressor 1, a diffuser portion 35 forming a diffuser passage 60 of the centrifugal compressor 1, and a scroll portion 36 forming a scroll passage 360 of the centrifugal compressor 1.

The intake air introduction path 50 is a passage for guiding the intake air (for example, fluid such as air) introduced from the intake port 31 of the compressor housing 3 toward the impeller blades 23. The diffuser passage 60 is a passage for guiding the fluid that has passed through the impeller 2 to the spiral scroll passage 360 provided around the impeller 2. The scroll passage 360 is a passage for guiding the fluid that has passed through the impeller 2 and the diffuser passage 60 to the outside of the compressor housing 3 through the discharge port 32 (see FIG. 1).

The intake air introduction path 50 and the scroll passage 360 are formed inside the compressor housing 3. The intake air introduction portion 34 has a front-side inner peripheral surface 5 forming the intake air introduction path 50. The front-side inner peripheral surface 5 is formed on the front side XF of the shroud surface 4 in the axial direction, and is positioned on the outer side in the radial direction Y than a front end 42 (the front side XF end) of the shroud surface 4. Further, the intake port 31 described above is formed at the front end of the intake air introduction portion 34.

The scroll passage 360 is formed and positioned on the outer side in the radial direction Y with respect to the impeller 2 so as to surround the impeller 2 housed in the compressor housing 3. The scroll portion 36 has a passage wall surface 361 forming the scroll passage 360.

In the shown embodiment, as shown in FIG. 2, the compressor housing 3 is combined with another member (the bearing housing 16 in the shown example) to form the diffuser passage 60 described above. The diffuser passage 60 is formed by a diffuser surface 6 and a surface 161 of the bearing housing 16 facing the diffuser surface 6. Note that in some other embodiments, the diffuser passage 60 may be formed inside the compressor housing 3.

The shroud portion 33 described above is provided between the intake air introduction portion 34 and the diffuser portion 35. The outlet of the intake air introduction path 50 communicates with the inlet of the diffuser passage 60, and the outlet of the diffuser passage 60 communicates with the inlet of the scroll passage 360. The fluid introduced into the compressor housing 3 through the intake port 31 is sent to the impeller 2 after flowing through the intake air introduction path 50 toward the rear side XR. The fluid sent to the impeller 2 flows through the diffuser passage 60 and the scroll passage 360 in this order, and then is discharged to the outside of the compressor housing 3 from the discharge port 32 (see FIG. 1).

At low flow rates of the centrifugal compressor 1 (the flow rate of the main flow MF that flows into the intake air introduction path 50 through the intake port 31 and flows to the impeller 2), an unstable phenomenon called surging occurs in which the fluid vibrates violently in the flow direction of the fluid may occur. When surging occurs, a reverse flow RF occurs in the vicinity of the shroud surface 4 in a direction opposite to the main flow MF, that is, toward the front side XF in the axial direction X, which may reduce the efficiency of the centrifugal compressor 1.

Figure 3:
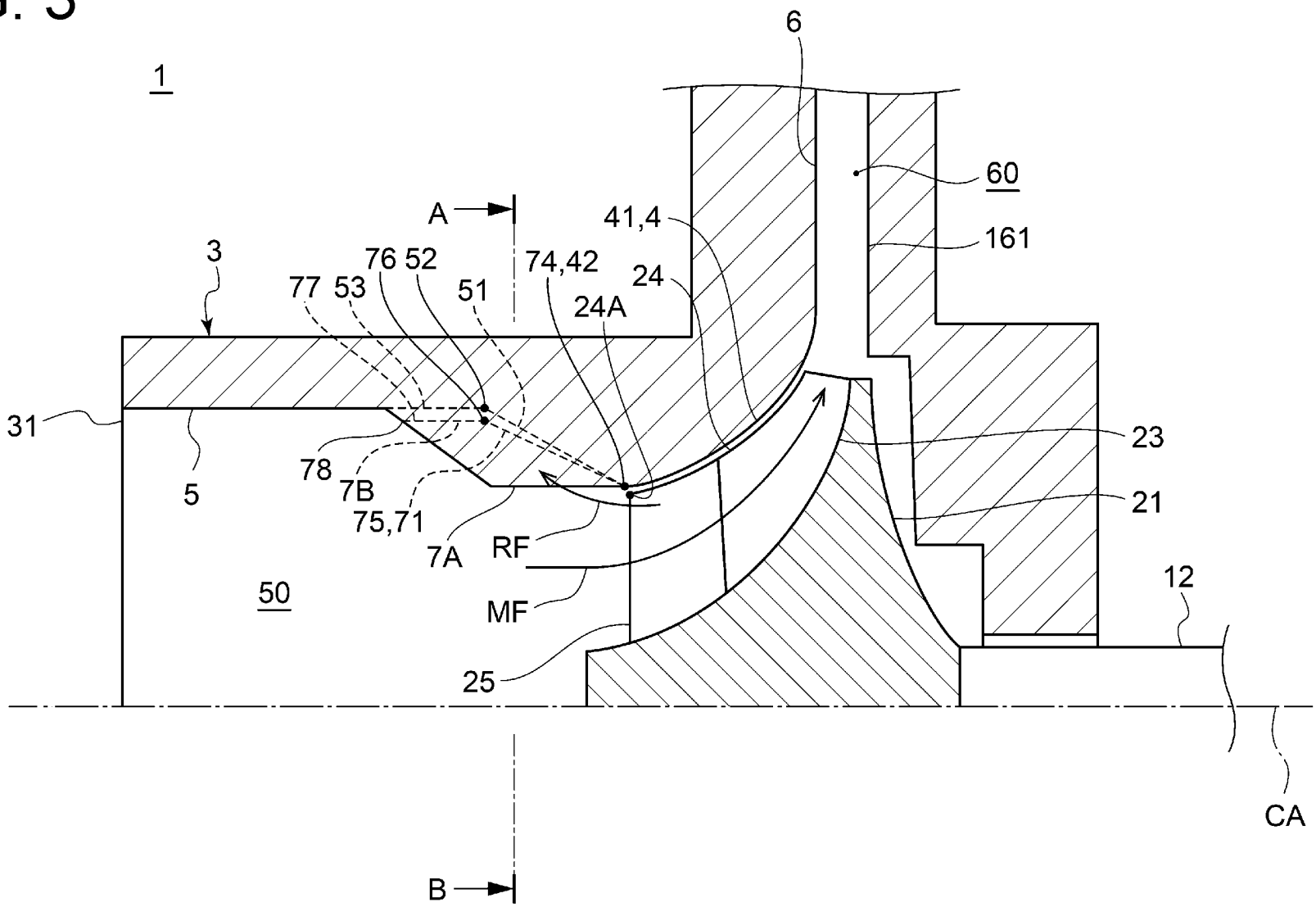
FIG. 3 is an explanatory diagram for explaining a compressor housing according to a first embodiment.
Figure 4:
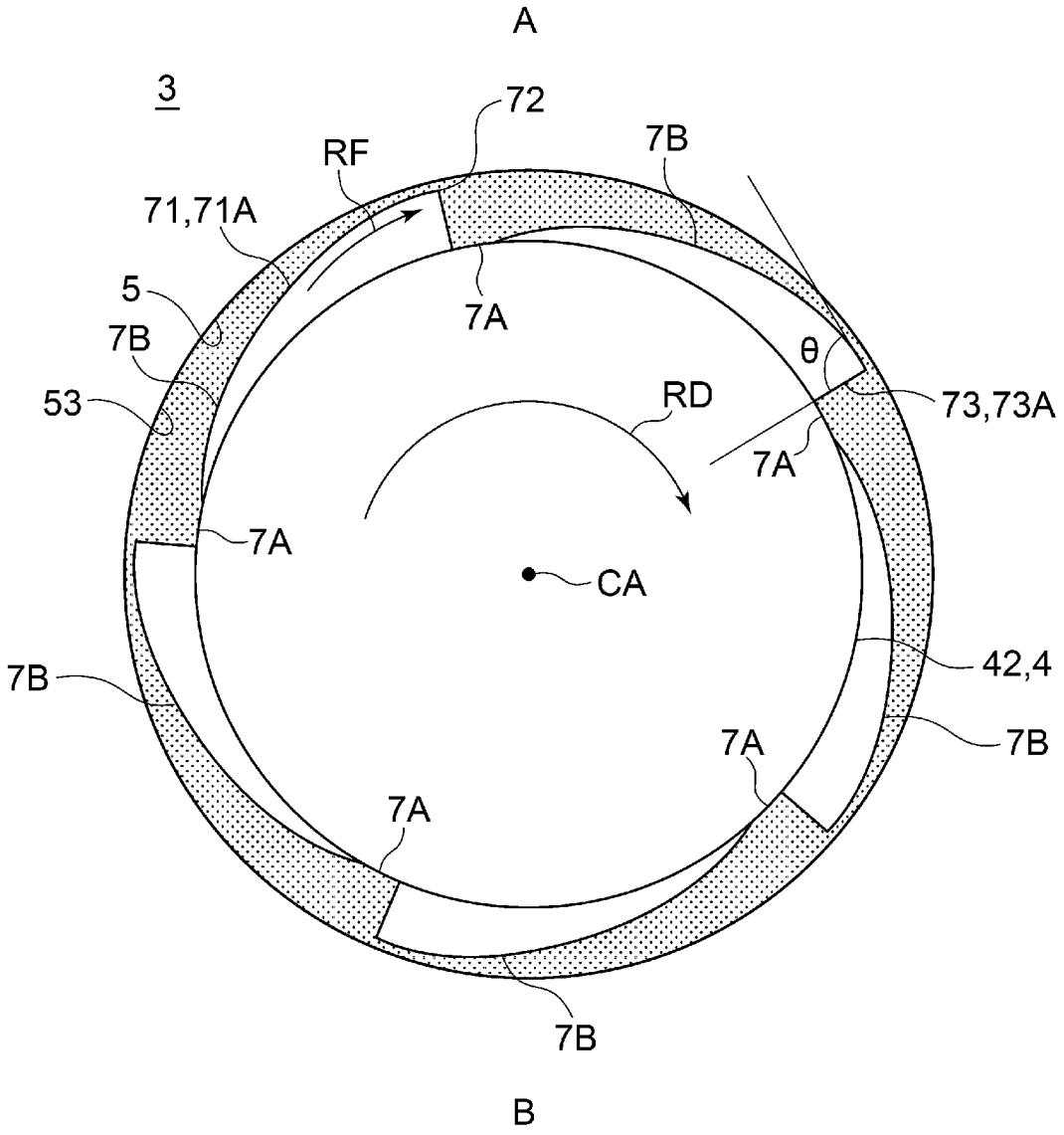
FIG. 4 is a schematic cross-sectional view schematically showing a cross-section taken along line A-B in FIG. 3.

FIG. 3 is an explanatory diagram for explaining the compressor housing according to the first embodiment. FIG. 4 is a schematic cross-sectional view schematically showing a cross-section along line A-B in FIG. 3. In FIG. 3, a cross-section along the axis CA of the impeller 2 of the centrifugal compressor 1 is schematically shown.

As shown in FIG. 3, the compressor housing 3 according to some embodiments includes the above-described shroud surface 4 including the surface 41 facing the tips 24 of the impeller blades 23 of the impeller 2 with a predetermined gap G, a front-side inner peripheral surface 5 formed on the front side XF of the shroud surface 4 in the axial direction and positioned on the outer side in the radial direction Y than the front end 42 of the shroud surface 4, and a plurality of protrusions 7A protruding from the front-side inner peripheral surface 5 toward the inner side in the radial direction.

Figure 5:
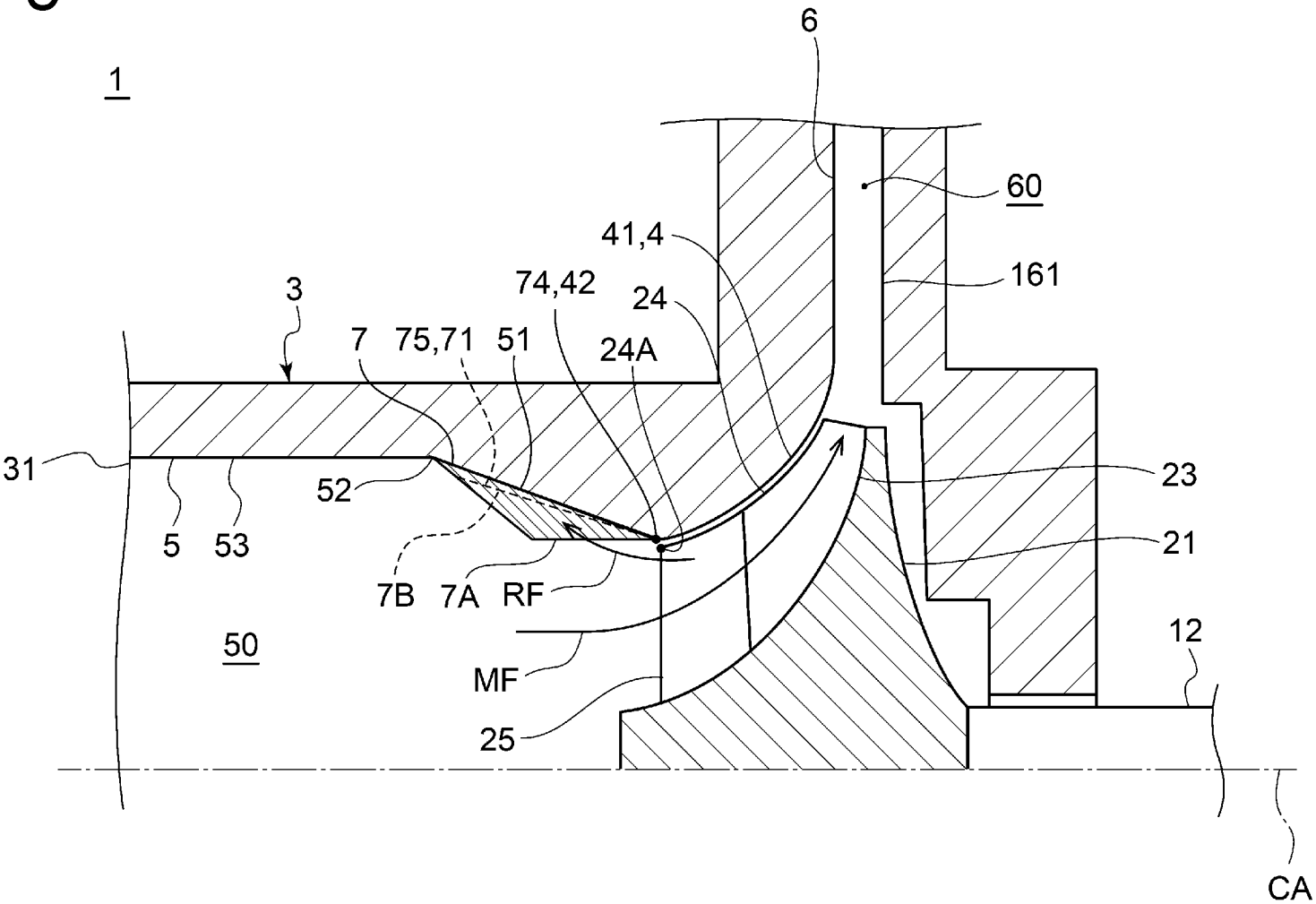
FIG. 5 is an explanatory diagram for explaining a modification of the compressor housing according to the first embodiment.

In a cross-sectional view viewed from the front side XF in the axial direction of the impeller 2 as shown in FIG. 5, each of the plurality of protrusions 7A is formed between adjacent grooves 7B among a plurality of grooves 7B formed in the front-side inner peripheral surface 5 at intervals in the circumferential direction. Further, in the cross-sectional view, each of the plurality of grooves 7B includes an inclined portion 71 whose depth gradually increases in the rotation direction RD of the impeller 2 and a stepped portion 73 formed at a downstream end 72 of the inclined portion 71 in the rotation direction RD. In the shown embodiment, the protrusion 7A is positioned on the outer side in the radial direction than a tip 24A of a leading edge 25 of the impeller 2.

According to the above configuration, the plurality of grooves 7B each including the inclined portion 71 and the stepped portion 73 is formed in the compressor housing 3. As described above, at low flow rates where the intake air flow rate of the centrifugal compressor 1 is low, the reverse flow RF may occur in the vicinity of the shroud surface 4. The reverse flow RF has a strong centrifugal action because the rotation of the impeller 2 imparts a rotation direction component directed in the rotation direction RD of the impeller 2. The inclined portion 71 can suppress the reverse flow RF by guiding the reverse flow RF having such a strong centrifugal action in the rotation direction RD along the inclined portion 71 so as to collide with the stepped portion 73 formed at the downstream end 72 of the inclined portion 71 in the rotation direction RD. By suppressing the reverse flow RF, the surge flow rate in the low-flow-rate-side operating region can be reduced, and consequently the efficiency of the centrifugal compressor 1 can be improved.

Further, according to the above configuration, since the depth of the groove 7B gradually increases in the rotation direction RD of the impeller 2, the flow of the main flow MF introduced into the impeller 2 entering the groove 7B is pushed toward the inner side in the radial direction from the groove 7B in a direction opposite to the rotation direction RD. As a result, the main flow MF introduced into the impeller 2 can be imparted with pre-rotation in the direction opposite to the rotation direction RD of the impeller 2, and the relative inflow velocity of the main flow MF when introduced into the impeller 2 can be increased by the pre-rotation. By increasing the relative inflow velocity of the main flow MF, the surge flow rate in the low-flow-rate-side operating region can be reduced, and consequently the efficiency of the centrifugal compressor 1 can be improved.

In some embodiments, as shown in FIG. 4, the inclined portion 71 described above includes an arc-shaped portion 71A curved in a concave shape toward the outer side in the radial direction. In this case, since the reverse flow RF can be smoothly guided in the rotation direction RD along the arc-shaped portion 71A, the collision between the reverse flow RF and the stepped portion 73 is promoted. In this way, the reverse flow RF can be effectively suppressed. In addition, since the groove 7B having the arc-shaped portion 71A can increase the space in the groove 7B, a large amount of the main flow MF introduced into the impeller 2 is caused to flow into the groove 7B, and a large amount of the main flow MF can be pushed toward the inner side in the radial direction from the groove 7B in the direction opposite to the rotation direction RD. As a result, the pre-rotation can be effectively imparted to the main flow MF introduced into the impeller 2, and the relative inflow velocity of the main flow MF when introduced into the impeller 2 can be increased.

In some embodiments, the above-described stepped portion 73 includes a stepped surface 73A that forms an angle θ of 120 degrees or less with respect to the inclined portion 71, as shown in FIG. 4. Preferably, the angle θ is 90 degrees or less. If the angle θ between the stepped portion 73 and the inclined portion 71 is large, the reverse flow RF flowing in the rotation direction RD along the inclined portion 71 of the groove 7B may flow along the stepped surface 73A (stepped portion 73) as it is and the collision between the reverse flow RF and the stepped surface 73A may become insufficient. According to the above configuration, the stepped portion 73 includes the stepped surface 73A forming an angle of 120 degrees or less with respect to the inclined portion 71. In this case, since the angle of collision between the reverse flow RF and the stepped surface 73A is small, the reverse flow RF can sufficiently collide with the stepped surface 73A, and the reverse flow RF can be effectively suppressed.

In some embodiments, as shown in FIG. 3, the rear end 74 of the groove 7B is configured to be connected to the front end 42 of the shroud surface 4. The effect of suppressing the reverse flow RF is high when the groove 7B is provided near the leading edge of the impeller 2 in the axial direction X. According to the above configuration, since the rear end 74 of the groove 7B is connected to the front end 42 of the shroud surface 4, the groove 7B is positioned near the leading edge 25 in the axial direction X, so that the reverse flow RF can be effectively suppressed. By suppressing the reverse flow RF, the surge flow rate in the low-flow-rate-side operating region can be reduced, and consequently the efficiency of the centrifugal compressor 1 can be improved.

In some embodiments, as shown in FIG. 3, the inclined portion 71 of the groove 7B includes at least a tapered surface 75 whose diameter increases as it advances from the rear end 74 of the groove 7B toward the front side XF. In the shown embodiment, the inclined portion 71 of the groove 7B further includes a bottom surface 77 extending from the front end 76 of the tapered surface 75 along the axial direction X toward the front side XF. In the embodiment shown in FIG. 3, the bottom portion (for example, the bottom surface 77) of the groove 7B is formed on the inner side in the radial direction than an axial surface 53. According to the above configuration, since the inclined portion 71 includes the tapered surface 75, it is possible to suppress the rapid contraction loss of the flow of the main flow MF introduced into the impeller 2. In addition, since the inclined portion 71 can smoothly guide the reverse flow RF in the rotation direction RD along the tapered surface 75, the collision between the reverse flow RF and the stepped portion 73 is promoted. In this way, the reverse flow RF can be effectively suppressed.

FIG. 5 is an explanatory diagram for explaining a modification of the compressor housing according to the first embodiment. In FIG. 5, a cross-section along the axis CA of the impeller 2 of the centrifugal compressor 1 is schematically shown.

In some embodiments, as shown in FIGS. 3 and 5, the front-side inner peripheral surface 5 described above includes the tapered surface 51 whose diameter increases as it advances from the front end 42 of the shroud surface 4 toward the front side XF and the axial surface 53 extending from the front end 52 of the tapered surface 51 along the axial direction X toward the front side XF. As shown in FIG. 5, the protrusion 7A described above is configured to protrude only from the tapered surface 51 of the front-side inner peripheral surface 5. In the shown embodiment, the protrusion 7A extends at least over the entire axial direction X of the tapered surface 51. In this case, by providing the protrusion 7A and the groove 7B on the tapered surface 51, the reverse flow RF can be effectively suppressed. In addition, by providing the protrusion 7A only on the tapered surface 51 of the front-side inner peripheral surface 5, that is, by not providing the protrusion 7A on the axial surface 53 of the front-side inner peripheral surface 5, the collision loss of the main flow MF due to collision with the protrusion 7A can be suppressed.

Note that, in some other embodiments, as shown in FIG. 3, the protrusion 7A described above may be configured to protrude from both the tapered surface 51 and the axial surface 53.

Figure 6:
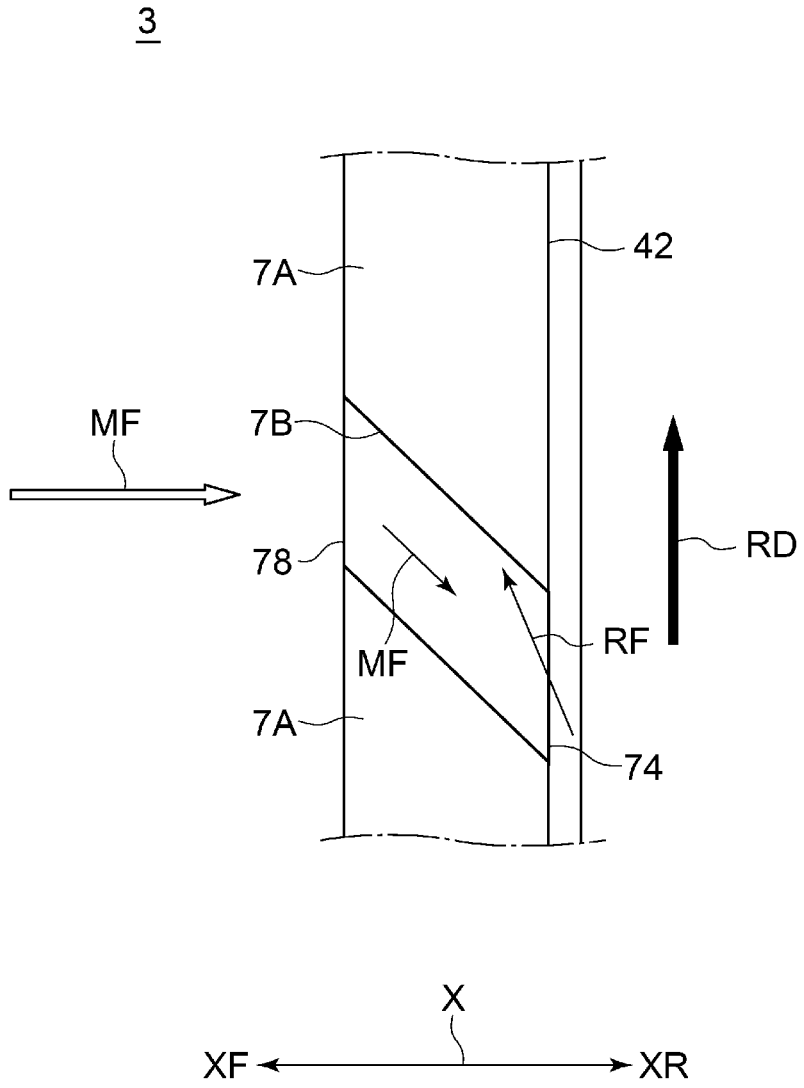
FIG. 6 is an explanatory diagram for explaining a compressor according to a second embodiment.

FIG. 6 is an explanatory diagram for explaining a compressor according to a second embodiment. FIG. 6 schematically shows a state in which the plurality of projections 7A and the plurality of grooves 7B are viewed from the inner side of the impeller 2 in the radial direction.

As shown in FIGS. 3 and 5, the compressor housing 3 according to some embodiments includes the above-described shroud surface 4 having the surface 41 facing the tips 24 of the impeller blades 23 of the impeller 2 with a predetermined gap G, the front-side inner peripheral surface 5 which is formed on the front side XF of the shroud surface 4 in the axial direction and which is positioned on the outer side in the radial direction Y than the front end 42 of the shroud surface 4, and the plurality of protrusions 7A protruding toward the inner side in the radial direction from the front-side inner peripheral surface 5.

In a cross-sectional view viewed from the front side XF in the axial direction of the impeller 2 as shown in FIG. 4, each of the plurality of protrusions 7A is formed between the adjacent grooves 7B among the plurality of grooves 7B formed in the front-side inner peripheral surface 5 at intervals in the circumferential direction. As shown in FIG. 6, each of the plurality of grooves 7B is configured such that the rear end 74 of the groove 7B is positioned on the upstream side in the rotation direction RD of the impeller 2 than the front end 78 of the groove 7B.

It should be noted that in some of the embodiments described above, the groove 7B extends along the axial direction X and the rear end 74 of the groove 7B is positioned at the same position in the rotation direction RD of the impeller 2 as the front end 78 of the groove 7B.

In the shown embodiment, the rear end 74 of the groove 7B is configured to be connected to the front end 42 of the shroud surface 4. As shown in FIG. 6, the groove 7B is formed linearly from the front end 78 to the rear end 74 when viewed from the inner side in the radial direction of the impeller 2.

According to the above configuration, the rear end 74 of the groove 7B is configured to be positioned on the upstream side in the rotation direction RD of the impeller 2 than the front end 78 of the groove 7B. Thus, by the groove 7B guiding the main flow MF introduced into the impeller 2, pre-rotation in the direction opposite to the rotation direction RD of the impeller 2 can be imparted to the main flow MF. By imparting the pre-swirl to the main flow MF, the relative inflow velocity of the main flow MF when introduced into the impeller 2 can be increased. By increasing the relative inflow velocity of the main flow MF, the surge flow rate in the low-flow-rate-side operating region can be reduced, and consequently the efficiency of the centrifugal compressor 1 can be improved.

It should be noted that the present embodiment may be combined with some of the above-described embodiments, or may be implemented independently. For example, as shown in FIG. 4, the present embodiment may be applied to the groove 7B including the inclined portion 71 and the stepped portion 73 described above, and the present embodiment may be applied to concave grooves other than the groove 7B.

In some embodiments, as shown in FIG. 3, each of the plurality of protrusions 7A described above is formed integrally with the front-side inner peripheral surface 5 (for example, the tapered surface 51) by machining or casting.

According to the above configuration, the protrusions 7A are formed integrally with the front-side inner peripheral surface 5 by machining or casting. In this case, the surface roughness of the protrusions 7A and the grooves 7B can be improved as compared to the case where the protrusion 7A manufactured separately from the front-side inner peripheral surface 5 is fixed to the front-side inner peripheral surface 5 by welding, bolt-fastening, or the like. By improving the surface roughness of the protrusions 7A and the grooves 7B, the pressure loss of the main flow MF introduced into the impeller 2 can be reduced.

In addition, in some embodiments, as shown in FIG. 5, the protrusions 7A described above may be manufactured separately from the front-side inner peripheral surface 5 described above. In the embodiment shown in FIG. 5, an annular body 7 having an inner surface in which the plurality of projections 7A and the plurality of grooves 7B are formed is supported inside the front-side inner peripheral surface 5.

In some of the above-described embodiments, the protrusions 7A and grooves 7B are provided on the upstream side of the impeller 2, but by providing such protrusions 7A and grooves 7B on the downstream side of the impeller 2, the reverse flow on the downstream side of the impeller 2 can be suppressed, and the efficiency of the centrifugal compressor 1 can be improved.

Figure 7:
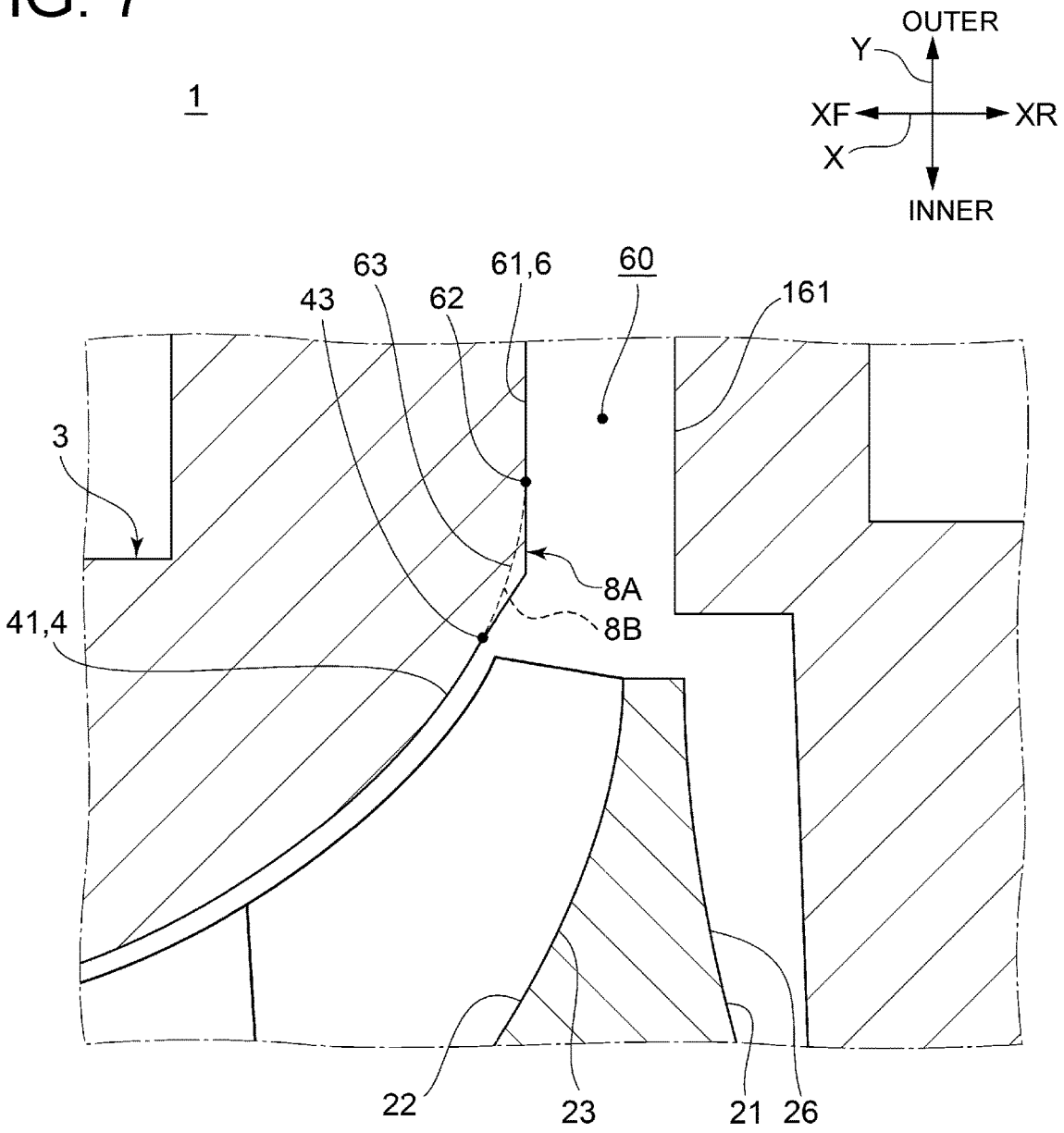
FIG. 7 is an explanatory diagram for explaining a compressor housing according to a third embodiment.
Figure 8:
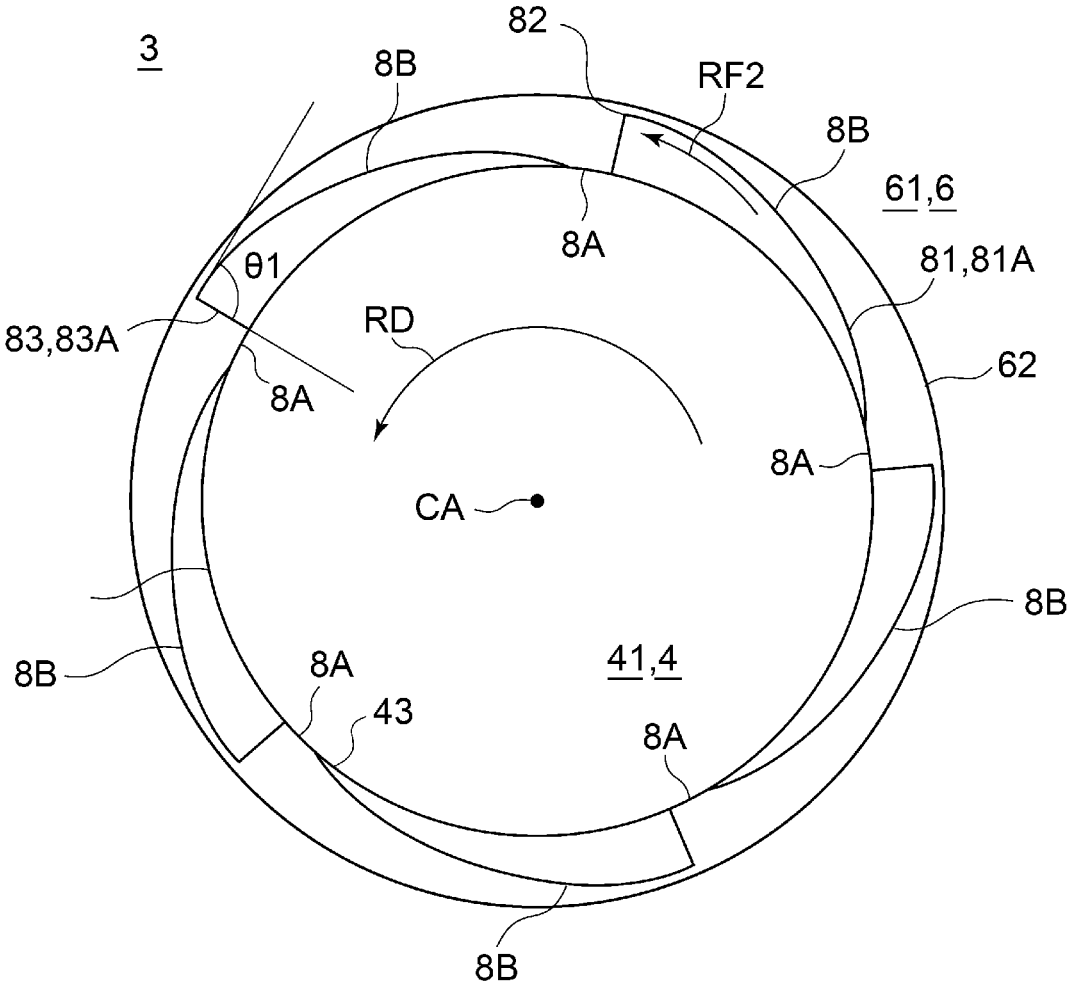
FIG. 8 is a schematic diagram schematically showing a state in which the vicinity of a pinch surface of the compressor housing shown in FIG. 7 is viewed from the rear side in the axial direction.

FIG. 7 is an explanatory diagram for explaining the compressor housing according to a third embodiment. FIG. 8 is a schematic diagram schematically showing a state in which the vicinity of the pinch surface of the compressor housing shown in FIG. 7 is viewed from the rear side in the axial direction. In FIG. 7, a cross-section along the axis CA of the impeller 2 of the centrifugal compressor 1 is schematically shown.

As shown in FIG. 7, the compressor housing 3 according to some embodiments includes the above-described shroud surface 4 including the surface 41 facing the tips 24 of the impeller blades 23 of the impeller 2 with a predetermined gap G, a diffuser surface 6 positioned on the suction surface 26 side (the rear side XR) of the impeller 2 in the axial direction than the rear end 43 of the shroud surface 4, the diffuser surface 6 including a radial surface 61 extending along the radial direction Y and a pinch surface 63 connecting an inner end 62 of the radial surface 61 and the rear end 43 of the shroud surface 4, and a plurality of diffuser-side protrusions 8A protruding from the pinch surface 63 toward the suction surface 26 side (the rear side XR) of the impeller 2 in the axial direction.

As shown in FIG. 8, when viewed from the rear side XR in the axial direction of the impeller 2, each of the diffuser-side protrusions 8A is formed between adjacent diffuser-side grooves 8B among a plurality of diffuser-side grooves 8B formed in the diffuser surface 6 at intervals in the circumferential direction.

According to the above configuration, the compressor housing 3 is provided with a plurality of diffuser-side grooves 8B formed in the pinch surface 63 at intervals in the circumferential direction. The plurality of diffuser-side grooves 8B can suppress the reverse flow RF2 having a rotation direction component directed in the rotation direction RD of the impeller 2 generated in the vicinity of the pinch surface 63, and suppress rotation pressure loss of the main flow MF on the downstream side of the impeller 2.

A non-uniform flow velocity distribution occurs on the downstream side of the impeller 2 in the centrifugal compressor 1. The plurality of diffuser-side protrusions 8A acts as a vortex generator to suppress boundary layer separation. Therefore, the efficiency of the centrifugal compressor 1 can be improved not only when a rotating stall occurs at the inlet of the diffuser passage 60 but also at the normal operating point of the centrifugal compressor 1.

In some embodiments, when viewed from the rear side XR in the axial direction of the impeller 2 as shown in FIG. 8, each of the plurality of diffuser-side grooves 8B includes a diffuser-side inclined portion 81 whose depth gradually increases toward the rotation direction RD of the impeller 2 and a diffuser-side stepped portion 83 formed at the downstream end 82 in the rotation direction RD of the diffuser-side inclined portion 81.

According to the above configuration, each of the diffuser-side grooves 8B includes the diffuser-side inclined portion 81 and the diffuser-side stepped portion 83. The reverse flow RF2 having a swirl component generated in the vicinity of the pinch surface 63 is guided along the diffuser-side inclined portion 81 in the rotation direction RD, and the reverse flow RF2 collides with the diffuser-side stepped portion 83 formed at the downstream end 82 of the diffuser-side inclined portion 81. In this way, the reverse flow RF2 can be suppressed.

In some embodiments, as shown in FIG. 8, the above-described diffuser-side inclined portion 81 includes an arc-shaped portion 81A curved in a concave shape toward the outer side in the radial direction. In this case, since the reverse flow RF2 can be smoothly guided in the rotation direction RD along the arc-shaped portion 81A, the collision between the reverse flow RF2 and the diffuser-side stepped portion 83 is promoted. In this way, the reverse flow RF2 can be effectively suppressed. In addition, since the diffuser-side groove 8B having the arc-shaped portion 81A can increase the space in the diffuser-side groove 8B, a large amount of the main flow MF introduced into the impeller 2 is caused to flow into the diffuser-side groove 8B, and a large amount of the main flow MF can be pushed toward the inner side in the radial direction from the diffuser-side groove 8B in the direction opposite to the rotation direction RD. In this way, a non-uniform flow velocity distribution can be suppressed.

In some embodiments, as shown in FIG. 8, the above-described diffuser-side stepped portion 83 includes a stepped surface 83A that forms an angle θ1 of 120 degrees or less with respect to the diffuser-side inclined portion 81. Preferably, the angle θ1 is 90 degrees or less. If the angle θ1 between the diffuser-side stepped portion 83 and the diffuser-side inclined portion 81 is large, the reverse flow RF2 flowing in the rotation direction RD along the diffuser-side inclined portion 81 of the diffuser-side groove 8B will flow along the stepped surface 83A as it is, and the collision between the reverse flow RF2 and the stepped surface 83A may become insufficient. According to the above configuration, the diffuser-side stepped portion 83 includes the stepped surface 83A that forms an angle of 120 degrees or less with respect to the diffuser-side inclined portion 81. In this case, since the angle of collision between the reverse flow RF2 and the stepped surface 83A is small, the reverse flow RF2 can sufficiently collide with the stepped surface 83A, and the reverse flow RF2 can be effectively suppressed.

It should be noted that this embodiment may be combined with some of the above-described embodiments, or may be implemented independently. For example, the compressor housing 3 may include the protrusion 7A described above and the diffuser-side protrusion 8A described above. In this case, the rotating stall on the upstream side and the downstream side of the impeller 2 can be suppressed, so that the efficiency of the centrifugal compressor 1 can be effectively improved by the synergistic effect of the protrusion 7A and the diffuser-side protrusion 8A.

In some embodiments, as shown in FIG. 7, the above-described diffuser-side protrusion 8A is formed integrally with the above-described diffuser surface 6 (for example, the pinch surface 63) by machining or casting.

According to the above configuration, the diffuser-side protrusion 8A is integrally formed with the diffuser surface 6 by machining or casting. In this case, the surface roughness of the diffuser-side groove 8B can be improved as compared to the case where the diffuser-side protrusion 8A, which is manufactured separately from the diffuser surface 6, is fixed to the diffuser surface 6 by welding, bolt-fastening, or the like. By improving the surface roughness of the diffuser-side groove 8B, the pressure loss of the main flow MF after passing through the impeller 2 can be reduced.

Note that, in some other embodiments, the diffuser-side protrusion 8A described above may be manufactured separately from the diffuser surface 6 described above.

As shown in FIGS. 1 and 2, the centrifugal compressor 1 according to some embodiments includes the compressor housing 3 described above. In this case, since the pressure loss of the operating fluid flowing through the compressor housing 3 can be effectively suppressed, the efficiency of the centrifugal compressor 1 can be improved.

The present invention is not limited to the above-described embodiments but includes modifications of the above-described embodiments and appropriate combinations of these modifications.

The contents described in the above-described embodiments are grasped as follows, for example.

(1) A compressor housing (3) according to at least one embodiment of the present disclosure is a compressor housing (3) for rotatably housing an impeller (2) of a centrifugal compressor (1), including: when an intake side in an axial direction of the centrifugal compressor is defined as a front side, and a side opposite to the intake side in the axial direction is defined as a rear side, a shroud surface (4) including a surface (41) facing a tip (24) of an impeller blade (23) of the impeller with a predetermined gap (G); a front-side inner peripheral surface (5) formed on the front side of the shroud surface (4) in the axial direction and positioned on an outer side in a radial direction than a front end (42) of the shroud surface (4); and a plurality of protrusions (7A) protruding toward an inner side in the radial direction from the front-side inner peripheral surface (5) and formed between adjacent grooves (7B) among a plurality of grooves (7B) formed in the front-side inner peripheral surface (5) at intervals in a circumferential direction, wherein each of the plurality of grooves (7B) includes: an inclined portion (71) whose depth gradually increases toward a rotation direction (RD) of the impeller (2); and a stepped portion (73) formed at a downstream end (72) of the inclined portion (71) in the rotation direction (RD).

According to the configuration of (1), the plurality of grooves each including the inclined portion and the stepped portion is formed in the compressor housing. At low flow rates where the intake air flow rate of the centrifugal compressor is low, the reverse flow may occur in the vicinity of the shroud surface. The reverse flow has a strong centrifugal action because the rotation of the impeller imparts a swirl component directed in the rotation direction of the impeller. The inclined portion can suppress the reverse flow by guiding the reverse flow having such a strong centrifugal action in the rotation direction along the inclined portion so as to collide with the stepped portion formed at the downstream end of the inclined portion in the rotation direction. By suppressing the reverse flow, the surge flow rate in the low-flow-rate-side operating region can be reduced, and consequently the efficiency of the centrifugal compressor can be improved.

Further, according to the configuration of (1), since the depth of the groove gradually increases in the rotation direction of the impeller, the flow of the main flow introduced into the impeller entering the groove is pushed toward the inner side in the radial direction from the groove in a direction opposite to the rotation direction. As a result, the main flow introduced into the impeller can be imparted with pre-swirl in the direction opposite to the rotation direction of the impeller, and the relative inflow velocity of the main flow when introduced into the impeller can be increased by the pre-swirl. By increasing the relative inflow velocity of the main flow, the surge flow rate in the low-flow-rate-side operating region can be reduced, and consequently the efficiency of the centrifugal compressor can be improved.

(2) In some embodiments, in the compressor housing (3) according to (1), the inclined portion (71) includes an arc-shaped portion (71A) curved in a concave shape toward an outer side in the radial direction.

According to the above configuration 2), the inclined portion includes an arc-shaped portion curved in a concave shape toward the outer side in the radial direction. In this case, since the reverse flow can be smoothly guided along the arc-shaped portion in the rotation direction, the collision between the reverse flow and the stepped portion is promoted. In this way, the reverse flow can be effectively suppressed. In addition, since the groove having the arc-shaped portion can increase the space in the groove, a large amount of the main flow introduced into the impeller is caused to flow into the groove, and a large amount of the main flow can be pushed toward the inner side in the radial direction from the groove in the direction opposite to the rotation direction. As a result, the pre-swirl can be effectively imparted to the main flow introduced into the impeller, and the relative inflow velocity of the main flow when introduced into the impeller can be increased.

(3) In some embodiments, in the compressor housing (3) according to (1) or (2), the stepped portion (73) includes a stepped surface (73A) forming an angle of 120 degrees or less with respect to the inclined portion (71).

If the angle between the stepped portion and the inclined portion is large, the reverse flow flowing in the rotation direction along the inclined portion of the groove may flow along the stepped surface (the stepped portion) as it is and the collision between the reverse flow and the stepped surface may become insufficient. According to the configuration of (3), the stepped portion includes the stepped surface forming an angle of 120 degrees or less with respect to the inclined portion. In this case, since the angle of collision between the reverse flow and the stepped surface is small, the reverse flow can sufficiently collide with the stepped surface, and the reverse flow can be effectively suppressed.

(4) In some embodiments, in the compressor housing (3) according to any one of (1) to (3), each of the plurality of grooves (7B) is configured such that a rear end (74) of the groove is positioned on an upstream side in the rotation direction (RD) of the impeller (2) than a front end (78) of the groove.

According to the configuration (4), the rear end of the groove is positioned on the upstream side in the rotation direction of the impeller than the front end of the groove. Thus, by the groove guiding the main flow introduced into the impeller, pre-swirl in the direction opposite to the rotation direction of the impeller can be imparted to the main flow. By imparting the pre-swirl to the main flow, the relative inflow velocity of the main flow when introduced into the impeller can be increased. By increasing the relative inflow velocity of the main flow, the surge flow rate in the low-flow-rate-side operating region can be reduced, and consequently the efficiency of the centrifugal compressor can be improved. In addition, since the groove includes the inclined portion and the stepped portion, pre-rotation can be effectively imparted to the main flow introduced into the impeller by the synergetic effect of the pre-swirl generated by the flow pushed in the direction opposite to the rotation direction from the groove.

(5) In some embodiments, in the compressor housing (3) according to any one of (1) to (4), each of the plurality of protrusions (7A) is formed integrally with the front-side inner peripheral surface (5) by machining or casting.

According to the configuration of (5), the protrusions are formed integrally with the front-side inner peripheral surface by machining or casting. In this case, the surface roughness of the protrusions and the grooves can be improved as compared to the case where the protrusion manufactured separately from the front-side inner peripheral surface is fixed to the front-side inner peripheral surface by welding, bolt-fastening, or the like. By improving the surface roughness of the protrusions and the grooves, the pressure loss of the main flow introduced into the impeller can be reduced.

(6) In some embodiments, the compressor housing (3) according to any one of (1) to (5), further including: a diffuser surface (6) positioned closer to a suction surface (26) side of the impeller (2) in the axial direction than a rear end (43) of the shroud surface (4), the diffuser surface (6) including a radial surface (61) extending along the radial direction and a pinch surface (63) connecting an inner end (62) of the radial surface (61) and the rear end (43) of the shroud surface (4); and a plurality of diffuser-side protrusions (8A) protruding from the pinch surface (63) toward the suction surface side of the impeller in the axial direction and formed between adjacent diffuser-side grooves (8B) among a plurality of diffuser-side grooves (8B) formed in the diffuser surface (6) at intervals in the circumferential direction.

According to the configuration of (6), the compressor housing is provided with the plurality of diffuser-side grooves formed in the pinch surface at intervals in the circumferential direction. The plurality of diffuser-side grooves can suppress the reverse flow having a swirl component directed in the rotation direction of the impeller generated in the vicinity of the pinch surface, and suppress swirling pressure loss of the main flow on the downstream side of the impeller.

A non-uniform flow velocity distribution occurs on the downstream side of the impeller in the centrifugal compressor. The plurality of diffuser-side protrusions acts as a vortex generator to suppress boundary layer separation. Therefore, the efficiency of the centrifugal compressor can be improved not only when a rotating stall occurs at the inlet of the diffuser passage but also at the normal operating point of the centrifugal compressor.

(7) In some embodiments, in the compressor housing (3) according to (6), each of the plurality of diffuser-side grooves (8B) includes: a diffuser-side inclined portion (81) whose depth gradually increases in the rotation direction of the impeller; and a diffuser-side stepped portion (83) formed at a downstream end (82) in the rotation direction of the diffuser-side inclined portion (81).

According to the configuration of (7), each of the diffuser-side grooves includes the diffuser-side inclined portion and the diffuser-side stepped portion. The reverse flow having a swirl component generated in the vicinity of the pinch surface is guided along the diffuser-side inclined portion in the rotation direction, and the reverse flow collides with the diffuser-side stepped portion formed at the downstream end of the diffuser-side inclined portion. In this way, the reverse flow can be suppressed.

(8) In some embodiments, in the compressor housing (3) according to (6) or (7), each of the plurality of diffuser-side protrusions (8A) is formed integrally with the diffuser surface (6) by machining or casting.

According to the configuration of (8), the diffuser-side protrusion is integrally formed with the diffuser surface by machining or casting. In this case, the surface roughness of the diffuser-side groove can be improved as compared to the case where the diffuser-side protrusion, which is manufactured separately from the diffuser surface, is fixed to the diffuser surface by welding, bolt-fastening, or the like. By improving the surface roughness of the diffuser-side groove, the pressure loss of the main flow after passing through the impeller can be reduced.

(9) A compressor housing (3) according to at least one embodiment of the present disclosure is a compressor housing (3) for rotatably housing an impeller (2) of a centrifugal compressor (1), including: when an intake side in an axial direction of the centrifugal compressor is defined as a front side, and a side opposite to the intake side in the axial direction is defined as a rear side, a shroud surface (4) including a surface (41) facing a tip (24) of an impeller blade (23) of the impeller with a predetermined gap (G); a front-side inner peripheral surface (5) formed on the front side of the shroud surface (4) in the axial direction and positioned on an outer side in a radial direction than a front end (42) of the shroud surface (4); and a plurality of protrusions (7A) protruding toward an inner side in the radial direction from the front-side inner peripheral surface (5) and formed between adjacent grooves (7B) among a plurality of grooves (7B) formed in the front-side inner peripheral surface (5) at intervals in a circumferential direction, wherein each of the plurality of grooves (7B) is configured such that a rear end (74) of the groove is positioned on an upstream side in a rotation direction (RD) of the impeller (2) than a front end (78) of the groove.

According to the configuration (9), the rear end of the groove is configured to be positioned on the upstream side in the rotation direction of the impeller than the front end of the groove. Thus, by the groove guiding the main flow introduced into the impeller, pre-swirl in the direction opposite to the rotation direction of the impeller can be imparted to the main flow. By imparting the pre-swirl to the main flow, the relative inflow velocity of the main flow when introduced into the impeller can be increased. By increasing the relative inflow velocity of the main flow, the surge flow rate in the low-flow-rate-side operating region can be reduced, and consequently the efficiency of the centrifugal compressor can be improved.

(10) A compressor housing (3) according to at least one embodiment of the present disclosure is a compressor housing (4) for rotatably housing an impeller (2) of a centrifugal compressor (1), including: when an intake side in an axial direction of the centrifugal compressor is defined as a front side, and a side opposite to the intake side in the axial direction is defined as a rear side, a shroud surface (4)

including a surface (41) facing a tip (24) of an impeller blade (23) of the impeller with a predetermined gap (G); a diffuser surface (6) positioned closer to a suction surface (26) side of the impeller (2) in the axial direction than a rear end (43) of the shroud surface (4), the diffuser surface (6) including a radial surface (61) extending along a radial direction and a pinch surface (63) connecting an inner end (62) of the radial surface (61) and the rear end (43) of the shroud surface (4); and a plurality of diffuser-side protrusions (8A) protruding from the pinch surface (63) toward the suction surface side of the impeller in the axial direction and formed between adjacent diffuser-side grooves (8B) among a plurality of diffuser-side grooves (8B) formed in the diffuser surface (6) at intervals in the circumferential direction, wherein each of the plurality of diffuser-side grooves (8B) includes: a diffuser-side inclined portion (81) whose depth gradually increases in the rotation direction of the impeller; and a diffuser-side stepped portion (83) formed at a downstream end (82) in the rotation direction of the diffuser-side inclined portion (81).

According to the configuration of (10), the compressor housing is provided with the plurality of diffuser-side grooves formed in the pinch surface at intervals in the circumferential direction. Each of the plurality of diffuser-side grooves includes the diffuser-side inclined portion and the diffuser-side stepped portion. The reverse flow having a swirl component directed in the rotation direction of the impeller generated in the vicinity of the pinch surface is guided in the rotation direction along the diffuser-side inclined portion, and the reverse flow collides with the diffuser-side stepped portion formed at the downstream end of the diffuser-side inclined portion. In this way, the reverse flow can be suppressed. As a result, swirling pressure loss of the main flow on the downstream side of the impeller can be suppressed. Therefore, according to the configuration of (10), it is possible to suppress the rotating stall at the inlet of the diffuser passage in the low-flow-rate-side operating region, and as a result, consequently it is possible to improve the efficiency of the centrifugal compressor.

A non-uniform flow velocity distribution occurs on the downstream side of the impeller in the centrifugal compressor. The plurality of diffuser-side protrusions acts as a vortex generator to suppress boundary layer separation. Therefore, the efficiency of the centrifugal compressor can be improved not only when a rotating stall occurs at the inlet of the diffuser passage but also at the normal operating point of the centrifugal compressor.

(11) A centrifugal compressor (1) according to at least one embodiment of the present disclosure including the compressor housing (3) according to any one of (1) to (10).

According to the configuration of (11), since the pressure loss of the fluid flowing through the compressor housing (3) can be effectively suppressed, the efficiency of the centrifugal compressor (1) can be improved.

REFERENCE SIGNS LIST

1 Centrifugal compressor
2 Impeller
21 Hub
22 Outer surface
23 Impeller blade
24 Tip
25 Leading edge
26 Suction surface
3 Compressor housing
31 Intake port
32 Discharge port
33 Shroud portion
34 Intake air introduction portion
35 Diffuser portion
36 Scroll portion
360 Scroll passage
361 Passage wall surface
4 Shroud surface
41 Surface
42 Front end
43 Rear end
5 Front-side inner peripheral surface
50 Intake air introduction path
51 Tapered surface
52 Front end
53 Axial surface
6 Diffuser surface
60 Diffuser passage
61 Radial surface
62 Inner end
63 Pinch surface
7 Annular body
7A Protrusion
7B Groove
71 Inclined portion
71A Arc-shaped portion
72 Downstream end
73 Stepped portion
73A Stepped surface
74 Rear end
75 Tapered surface
76, 78 Front end
77 Bottom surface
8A Diffuser-side protrusion
8B Diffuser-side groove
81 Diffuser-side inclined portion
81A Arc-shaped portion
82 Downstream end
83 Diffuser-side stepped portion
83A Stepped surface
10 Turbocharger
11 Turbine
12 Rotating shaft
13 Turbine rotor
14 Turbine housing
141 Turbine-side intake port
142 Turbine-side discharge port
15 Bearing
16 Bearing housing
CA Axis
G Gap
MF Main flow
RD Rotation direction
RF, RF2 Reverse flow
X Axial direction
XF Front side (in axial direction)
XR Rear side (in axial direction)
Y Radial direction

The invention claimed is:

1. A compressor housing for rotatably housing an impeller of a centrifugal compressor, comprising:

when an intake side in an axial direction of the centrifugal compressor is defined as a front side, and a side opposite to the intake side in the axial direction is defined as a rear side, a shroud surface including a surface facing a tip of an impeller blade of the impeller with a predetermined gap;

a front-side inner peripheral surface formed on the front side of the shroud surface in the axial direction and positioned on an outer side in a radial direction than a front end of the shroud surface; and a plurality of protrusions protruding toward an inner side in the radial direction from the front-side inner peripheral surface and formed between adjacent grooves among a plurality of grooves formed in the front-side inner peripheral surface at intervals in a circumferential direction, wherein each of the plurality of grooves includes:

an inclined portion whose depth gradually increases toward a rotation direction of the impeller; and a stepped portion formed at a downstream end of the inclined portion in the rotation direction, the stepped portion being a wall extending along the radial direction.

2. The compressor housing according to claim 1, wherein the inclined portion includes an arc-shaped portion curved in a concave shape toward an outer side in the radial direction.

3. The compressor housing according to claim 1, wherein the stepped portion includes a stepped surface forming an angle of 120 degrees or less with respect to the inclined portion.

4. The compressor housing according to claim 1, wherein each of the plurality of grooves is configured to have a rear end of the groove on an upstream side in the rotation direction of the impeller with respect to the front end of the groove.

5. The compressor housing according to claim 1, wherein each of the plurality of protrusions is formed integrally with the front-side inner peripheral surface by machining or casting.

6. A compressor housing for rotatably housing an impeller of a centrifugal compressor, comprising:

when an intake side in an axial direction of the centrifugal compressor is defined as a front side, and a side opposite to the intake side in the axial direction is defined as a rear side, a shroud surface including a surface facing a tip of an impeller blade of the impeller with a predetermined gap;

a front-side inner peripheral surface formed on the front side of the shroud surface in the axial direction and positioned on an outer side in a radial direction than a front end of the shroud surface; and a plurality of protrusions protruding toward an inner side in the radial direction from the front-side inner peripheral surface and formed between adjacent grooves among a plurality of grooves formed in the front-side inner peripheral surface at intervals in a circumferential direction, wherein each of the plurality of grooves includes:

an inclined portion whose depth gradually increases toward a rotation direction of the impeller; and a stepped portion formed at a downstream end of the inclined portion in the rotation direction, and wherein the compressor housing further comprises:

a diffuser surface positioned closer to a suction surface side of the impeller in the axial direction than a rear end of the shroud surface, the diffuser surface including a radial surface extending along the radial direction and a pinch surface connecting an inner end of the radial surface and the rear end of the shroud surface; and a plurality of diffuser-side protrusions protruding from the pinch surface toward the suction surface side of the impeller in the axial direction and formed between adjacent diffuser-side grooves among a plurality of diffuser-side grooves formed in the diffuser surface at intervals in the circumferential direction.

7. The compressor housing according to claim 6, wherein each of the plurality of diffuser-side grooves includes:

a diffuser-side inclined portion whose depth gradually increases in the rotation direction of the impeller; and a diffuser-side stepped portion formed at a downstream end in the rotation direction of the diffuser-side inclined portion.

8. The compressor housing according to claim 6, wherein each of the plurality of diffuser-side protrusions is formed integrally with the diffuser surface by machining or casting.

9. A compressor housing for rotatably housing an impeller of a centrifugal compressor, comprising: when an intake side in an axial direction of the centrifugal compressor is defined as a front side, and a side opposite to the intake side in the axial direction is defined as a rear side, a shroud surface including a surface facing a tip of an impeller blade of the impeller with a predetermined gap; a front-side inner peripheral surface formed on the front side of the shroud surface in the axial direction and positioned on an outer side in a radial direction than a front end of the shroud surface; and a plurality of protrusions protruding toward an inner side in the radial direction from the front-side inner peripheral surface and formed between adjacent grooves among a plurality of grooves formed in the front-side inner peripheral surface at intervals in a circumferential direction, wherein each of the plurality of grooves is configured to have a rear end of the groove on an upstream side in the rotation direction of the impeller with respect to the front end of the groove; an inclined portion whose depth gradually increases toward a rotation direction of the impeller; and a stepped portion formed at a downstream end of the inclined portion in the rotation direction; and the stepped portion being a wall extending along the radial direction.

10. A compressor housing for rotatably housing an impeller of a centrifugal compressor, comprising:

when an intake side in an axial direction of the centrifugal compressor is defined as a front side, and a side opposite to the intake side in the axial direction is defined as a rear side, a shroud surface including a surface facing a tip of an impeller blade of the impeller with a predetermined gap;

a diffuser surface positioned closer to a suction surface side of the impeller in the axial direction than a rear end of the shroud surface, the diffuser surface including a radial surface extending along a radial direction and a pinch surface connecting an inner end of the radial surface and the rear end of the shroud surface; and a plurality of diffuser-side protrusions protruding from the pinch surface toward the suction surface side of the impeller in the axial direction and formed between adjacent diffuser-side grooves among a plurality of diffuser-side grooves formed in the diffuser surface at intervals in the circumferential direction, wherein each of the plurality of diffuser-side grooves includes:

a diffuser-side inclined portion whose depth gradually increases in the rotation direction of the impeller; and a diffuser-side stepped portion formed at a downstream end in the rotation direction of the diffuser-side inclined portion.

11. A centrifugal compressor comprising the compressor housing according to claim 1.

* * * * *